US005360028A

United States Patent [19]

Jasin

[11] Patent Number: 5,360,028

[45] Date of Patent: Nov. 1, 1994

[54] SELF-ERECTING TENT ON FOLDING BASE

[76] Inventor: Mark S. Jasin, 3333 Blake St., Denver, Colo. 80205

[21] Appl. No.: 212,563

[22] Filed: Mar. 11, 1994

[51] Int. Cl.[5] ..... E04H 15/36

[52] U.S. Cl. ..... 135/137; 135/119; 446/478; 446/487

[58] Field of Search ..... 135/96, 95, 102, 103, 135/104, 106, 109, 113, 116, 117, 119; 446/478, 487, 479; 52/63, 79.5; 607/81, 82, 83, 91

[56] References Cited

U.S. PATENT DOCUMENTS

| | | | |
|---|---|---|---|
| D. 184,691 | 3/1959 | Siegel et al. . | |
| D. 296,223 | 6/1988 | Shimasaki . | |
| 1,428,405 | 9/1922 | Wegener | 446/478 |
| 1,658,214 | 2/1928 | Thomas . | |
| 2,415,343 | 2/1947 | Dunn . | |
| 2,895,256 | 7/1959 | Miller | 446/478 X |
| 3,675,667 | 7/1972 | Miller . | |
| 3,751,741 | 8/1973 | Hendry . | |
| 3,840,919 | 10/1974 | Middleton | 135/96 X |
| 4,067,137 | 1/1978 | Korthase | 446/478 |
| 4,085,762 | 4/1978 | O'Brian et al. | 446/478 X |
| 4,180,112 | 12/1979 | Bovet . | |
| 4,585,020 | 4/1986 | Masuda et al. . | |
| 4,719,935 | 1/1988 | Gustafson . | |
| 4,766,918 | 8/1988 | Odekirk | 135/96 X |
| 4,858,634 | 8/1989 | McLeese . | |
| 4,964,249 | 10/1990 | Payne | 446/478 X |
| 5,038,812 | 8/1991 | Norman . | |
| 5,059,463 | 10/1991 | Peters . | |
| 5,080,119 | 1/1992 | Scherer | 135/104 |
| 5,184,436 | 2/1993 | Sadler | 446/478 X |
| 5,249,592 | 10/1993 | Springer et al. . | |

FOREIGN PATENT DOCUMENTS

| | | |
|---|---|---|
| 1250995 | 12/1960 | France . |
| 2377172 | 9/1978 | France . |

*Primary Examiner*—Carl D. Friedman
*Assistant Examiner*—Lan C. Mai
*Attorney, Agent, or Firm*—John B. Phillips; Lee R. Osman

[57] ABSTRACT

A base having a top surface, a bottom surface, and a shape symmetrical about a fold line defining first and second halves is selectively moveable between an open position and a closed position. A substantially concave shell has an open bottom defining an outer periphery which is releasably attached to the top surface of the base. A resilient frame member supports the shell above the top surface of the base to define an interior volume between the base and the shell when the tent is in the open position. The shell and the resilient frame member collapse and fit between the first and second halves of the base when the two base halves are moved to the closed position. The base extends beyond the outer periphery of the shell, providing an area for the user to enjoy while being protected from the support surface.

19 Claims, 5 Drawing Sheets

10
18
16
90
90
12
24
28
50
26
46

16
22
18
90
90
90
90
12
24
28
46
114
50
14
26

10
74
16
18
8
12
29
50
50
8
26

9
10
37
36
41
46

26
50
50
9
10

28
24
33
16
90
74
62
90
14
60
90
90
10

32
46

SELF-ERECTING TENT ON FOLDING BASE

This invention relates generally to self-erecting tents, and more specifically to a new and improved tent mounted on a foldable base that automatically erects when the base is unfolded.

BACKGROUND

Tents have been utilized for many years to provide privacy and shelter from the weather. Traditionally, tents have been constructed of a shell made of flexible weather-resistant material. The shell was supported by a separate frame which was connected to the shell either externally or internally. Setting up the tent often required more than one person due to the complexity of coordinating frame members with respect to the shell. Once the tent was erected, the tent was secured to the ground by any number of means, such as staking the perimeter of the shell to the ground. Staking the tent to the ground also helped keep the tent erect. Some tents required guy lines running between the ends of the tent and the ground or other objects in order to maintain the engagement between the shell and the frame and thus keep the tent erect.

As technology has developed and the uses of tents have become more specialized, tent structures have changed drastically. While large outdoor tents still have frames separate from the shell and require more than one person to erect, tents used for a small number of people, such as for camping, have been simplified. For instance, the materials used for the shell are much lighter in weight and more weather resistant to allow the tent to be folded up into a smaller space for convenient transport in a back pack and also to withstand inclement weather. Additionally, the frame systems are stronger and easier to set up, usually requiring only one person. In many types of camping tents, the frame members are resilient and provide sufficient engagement with the shell to be self-supporting, thus alleviating any need for guy lines to help keep the tent in an erect position. Most tents, however, still require some form of mechanism to attach the tent to the ground to keep it from moving in high winds or for other reasons.

Tents have become popular play items for children and young adults. They provide relatively inexpensive structures for use by children during play, their use being limited only by the imagination of the children. Camping tents, while light weight, portable, and relatively easy to erect, are not ideal for children's play toys. Camping tents are made of materials specifically suited for providing sturdy shelter for outdoor use, oftentimes allowing the user to depend on the tent in potentially life-threatening situations. Camping tents are thus overbuilt for use as play toys for children.

With these lower performance standards in mind, play tent makers have developed play tents concentrating more on easy erection and portability as opposed to weather protection and structural strength. Play tents have been developed based on the traditional shape of the tent, generally having four sides and a roof. The basic structure of play tents have been only minimally transformed into play items for children, for instance by decorating the exterior of the tent with certain designs that represent any number of favorite scenes for children. Many of these tents are inconvenient to assemble and disassemble, and they typically include many separate components which must be stored when the tent is not in use.

Recently, both camping and play tents have been developed with integral frames that automatically erect the tent. This type of tent uses a frame made of resilient material that springs into a predetermined form when released from a stored position. Conversely, these same tents are able to be reduced in size by bending or twisting the resilient frame into the stored position. The benefits of having a self-erecting and easily stored tent are countered by the fact that only limited tent shapes can result from this type of frame. Typically, the tent shapes formed by the self-erecting resilient tent frames are limited to a tubular, smooth, nondescript shape. As a play tent, a greater variety of shapes would be beneficial by providing more options for fanciful designs.

It is with respect to these considerations and other background information relative to prior art tents that the significant improvements of the present invention have evolved.

SUMMARY OF THE INVENTION

The present invention in general terms concerns a tent mounted on a folding base that automatically erects when the base is unfolded. The automatically erecting tent of the present invention overcomes many of the afore-mentioned problems. The tent is easily set up and taken down, and is convenient to store and transport, among several other important advantages that are discussed below.

The self-erecting tent of the present invention includes a base having a top surface, a bottom surface, and a shape symmetrical about a fold line defining first and second halves which are selectively moveable between an open position, in which the bottom surface of the base is supported on a support surface, and a closed position in which the two halves are folded over upon one another along the fold line. A substantially concave shell includes an open bottom having an outer periphery attached to the top surface of the base. The outer periphery of the shell is symmetrical about a line of symmetry extending between a front end and a rear end of the shell, and the shell is attached to the top surface of the base so that the line of symmetry is coincident with and overlies the fold line of the base.

A resilient frame member supports the shell above the top surface of the base to define an interior volume between the base and the interior surface of the shell when the tent is in the open position. The shell and the resilient frame member collapse and fit between the first and second halves of the base when the two halves are moved to the closed position.

To prepare the tent for use, the user simply unfolds the base to automatically or self-erect the tent. In its erected state, the tent preferably includes a door for the user's ingress and egress in addition to a transparent portion which acts as a window. If the user wishes to transport the erect tent only a short distance, the user can grasp the base or the shell and move the tent to the desired location. In one preferred embodiment, the outer periphery of the shell is releasably attachable to the top surface of the base, thereby allowing the base, shell, and frame to be cleaned separately. The base preferably extends beyond the outer periphery of the shell, providing an area for the user to enjoy while being protected from the support surface. The interior of the tent is of sufficient size to accommodate a sleeping bag, and provision may be made for the sleeping bag to be releasably attachable to the top surface of the base within the interior.

In one preferred embodiment, the base of the tent is padded to provide a comfortable protective layer between the user and the support surface. In another preferred embodiment, the base is a thin flexible sheet that provides the user with protection from the support surface, but does not provide comfortable padding. In either of these embodiments, the shell may be fancifully designed so that the tent may be used as a child's play toy. The shell design may also be tailored for a number of different uses, including portable pet kennels and sun shades.

When the tent is to be stored or transported to a different location, the user simply folds the two halves of the base together. The shell and resilient frame member collapse between the two halves of the base to allow the two halves to fold into a position nearly adjacent to one another.

Accordingly, it is the primary object of the present invention to provide an automatically erecting tent that is readily reduced to a small size for convenient storage and portability.

It is another object of the present invention to provide a tent mounted on a foldable base that collapses between opposing halves of the base when the base is folded.

Still another object of the present invention is to provide a tent mounted on a foldable base that self erects from between the portions of the base when the base is unfolded.

It is another object of the present invention to provide a tent mounted on a foldable base that provides for releasably securing a sleeping bag in the interior of the tent.

It is yet another object of the present invention to provide a tent mounted on a foldable base that provides an area external but adjacent to the tent shell that the user can utilize and enjoy and that protects the user from the support surface.

A further object of the present invention is to provide a tent mounted on a foldable base wherein the base is padded.

Another object of the present invention is to provide a tent mounted on a folding base wherein the tent is removable and re-attachable to the foldable base.

Other aspects, features and details of the present invention can be more completely understood by reference to the following detailed description of a preferred embodiment, in conjunction with the drawings, and from the appended claims.

DESCRIPTION OF THE PREFERRED EMBODIMENT

Figure 1:
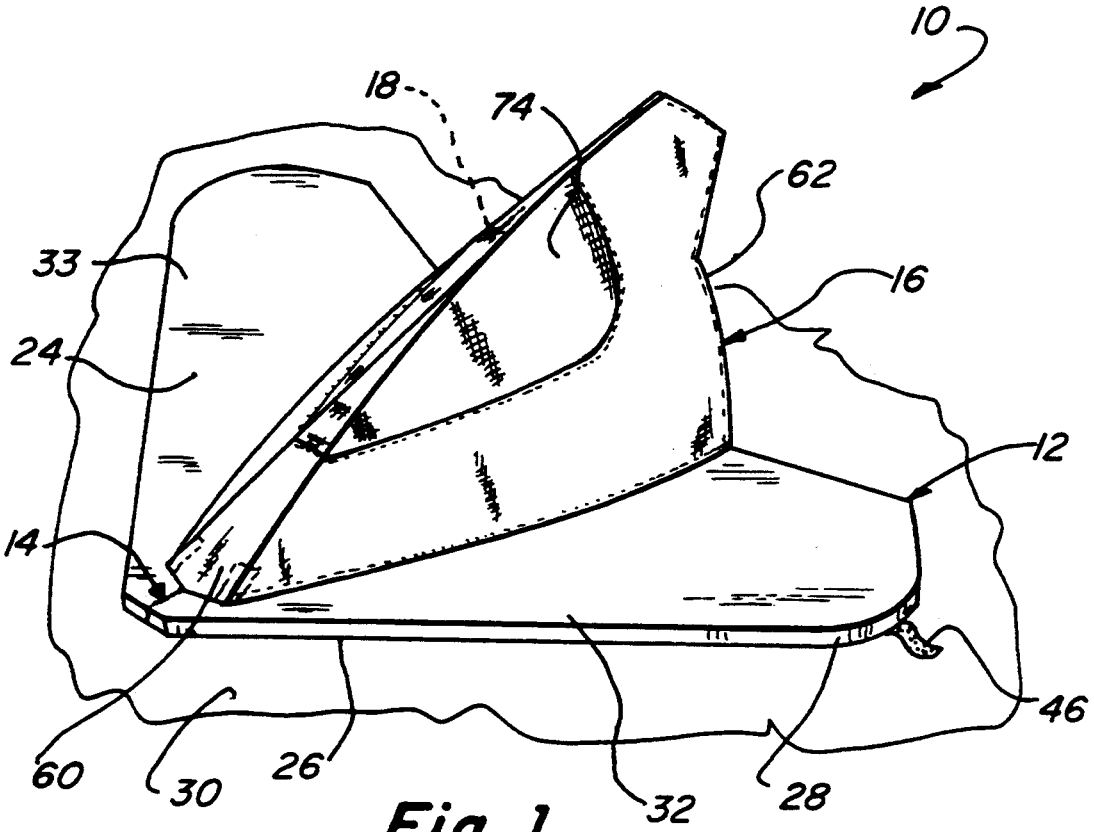
FIG. 1 is an isometric view of a self-erecting tent of the present invention shown in an open position.

Referring first to FIG. 1, the automatically or self-erecting tent 10 includes a base 12 foldable along a fold line 14, a shell 16 releasably attached to the base, and a frame 18 interior to and supporting the shell. The frame engages the shell so that when the tent is in the unfolded and open position, the shell defines an interior volume 20 of sufficient size to hold at least one person. In the open position, the shell defines an aperture 22 through which the user can enter into and exit from the tent. When the base is folded into a closed position, for storage or transportation, the shell and frame collapse to fit between folded halves of the base. In the closed position, the shell and frame fit entirely within the perimeter of the folded base.

In one preferred embodiment, the self-erecting tent may be used as a child's play toy. When used as a child's play toy, the tent can simulate an object that a child would enjoy playing with. The embodiment illustrated in FIG. 1 simulates a space craft type of vehicle.

The base or mat 12 is planar in shape having a top surface 24, a bottom surface 26 and defining an outer periphery 28. The bottom surface engages a substantially planar support surface 30 on which the tent 10 rests. Preferably the mat 12 has a shape which is symmetrical about the fold line 14, allowing the outer periphery 28 to match and form a continuous shape when in the folded position.

In a first embodiment shown in FIGS. 1–11, the base 12 comprises two padded halves 32 and 33, each having a inner end 34,35, an outer end 36,37, a top surface 38,39 and a bottom surface 40,41. The padded halves 32,33 are preferably formed of plastic (e.g. closed cell foam), and are approximately one (1.0) inch thick. The top 38,39 and bottom 40,41 surfaces of the two padded halves correspond to the top 24 .and bottom 26 surfaces of the base 12. The padded base offers the user enhanced comfort and protection for use on many different types of support surfaces.

Figure 7:
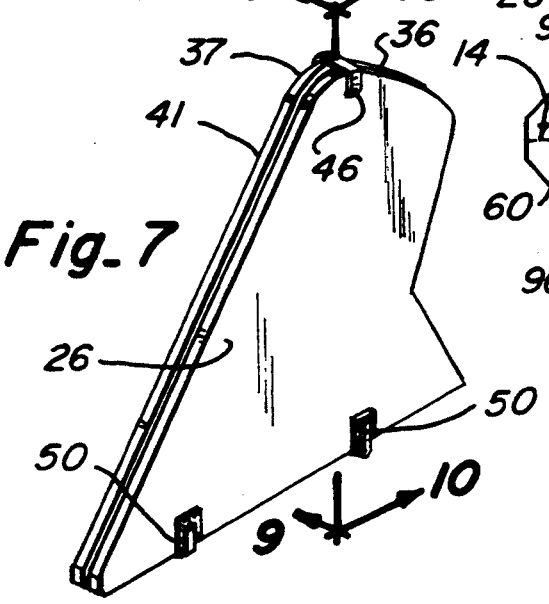
FIG. 7 is an isometric view illustrating the tent shown in FIG. 1 in a folded or closed position.

The two halves 32 and 33 of the base 12 abut one another along their inner ends 34,35 along the fold line 14. A flexible floormat 42, preferably formed of plastic, is fixed to the top surfaces 38,39 of both of the first 32 and second 33 base halves to connect the two halves together. In addition to helping hold the two base halves together, the flexible floormat 42 acts as a living hinge 44 allowing the first and second mat portions to be pivoted at their inner ends 35,36 about the fold line 14, from a closed position to an open position, as shown in FIGS. 7 and 1, respectively. In the folded or closed position, as shown in FIG. 10, the top surfaces 38,39 of the halves 32,33 face one another.

Figure 10:
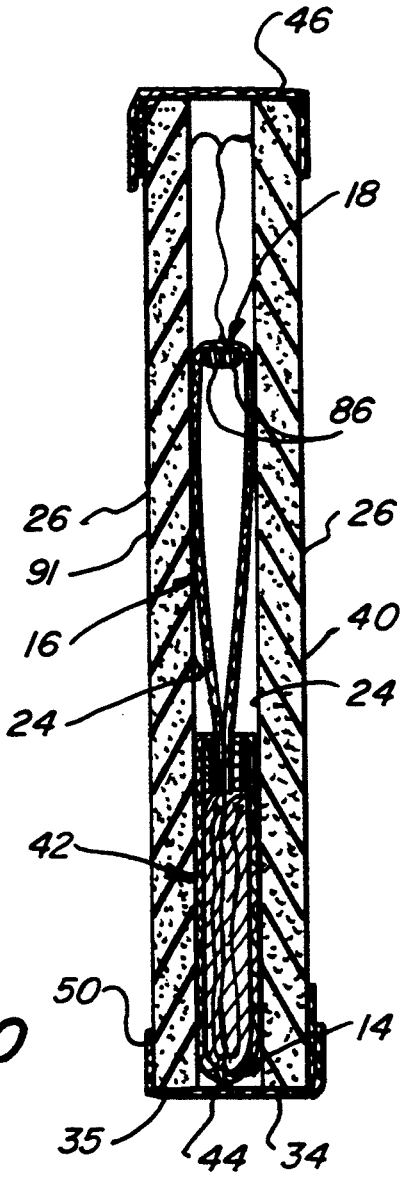
FIG. 10 is a section view taken substantially along the line 10—10 of FIG. 7.

The two halves may be maintained in the folded or closed position by a fastener strap 46 (FIGS. 7 and 10). The strap is fixed to the bottom surface 40 at the outer end 36 of one of the first half 32, and releasably attached to the bottom surface 41 at the outer end 37 of the second half 33. A releasable fastener such as Velcro ® may be used to releasably attach the strap.

Figure 5:
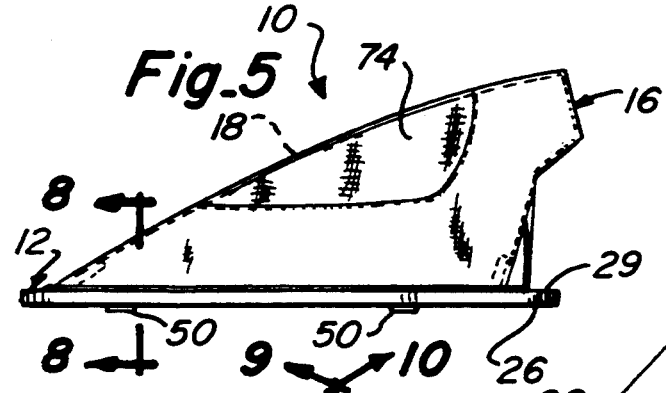
FIG. 5 is a side elevational view of the tent shown in FIG. 1.
Figure 11:
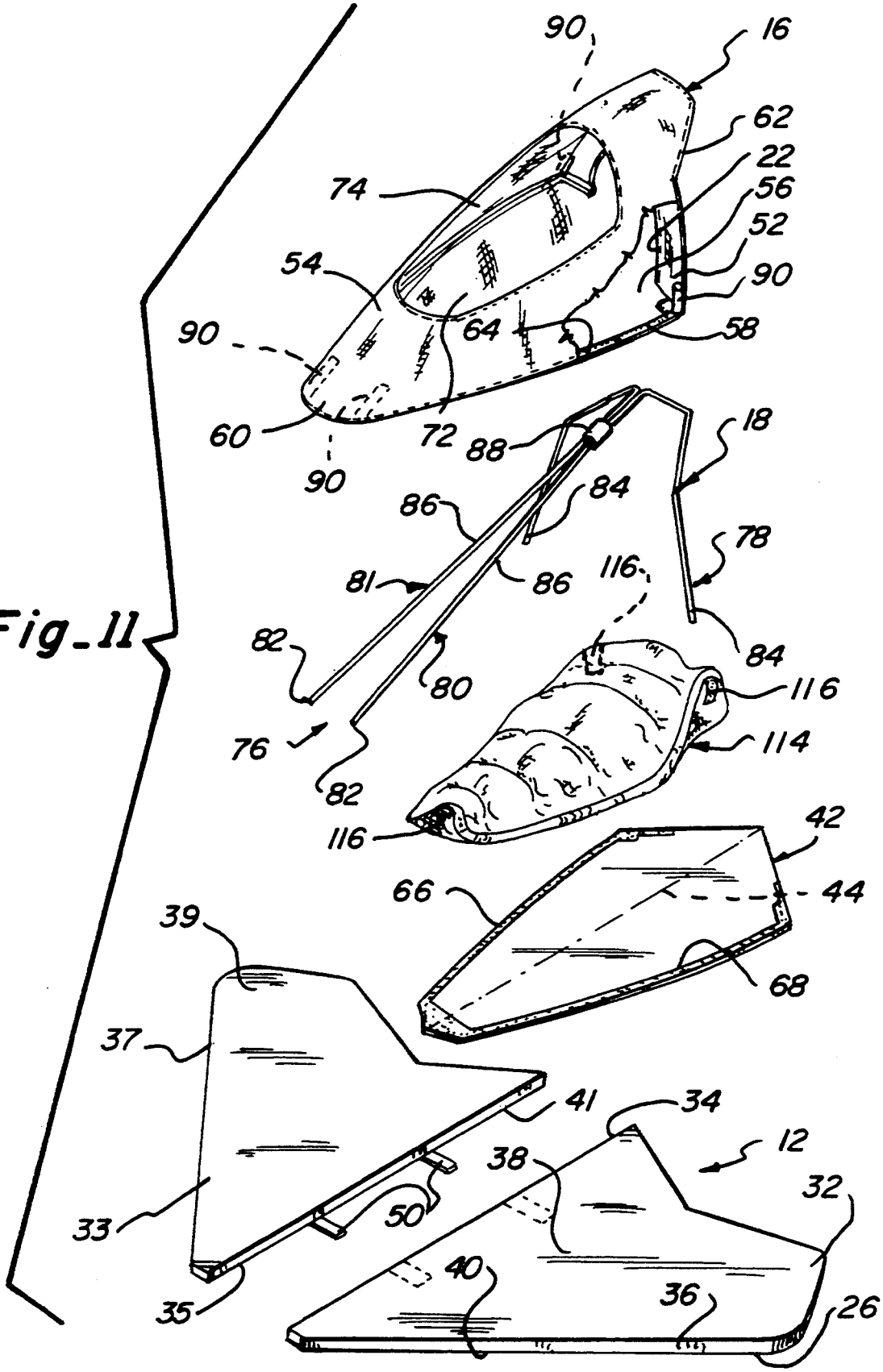
FIG. 11 is an exploded view of the self-erecting tent shown in FIG. 1.

In the unfolded or open position, at least one tensioner strap 50 spans the fold line 14 on the bottom surface 26 of the base 12 (two straps are shown in FIGS. 5, 7, and 11). The tensioner strap comprises a flexible strap that may be attached to the bottom surfaces of the two base halves 32,33 across the fold line once the base has been unfolded. Velcro ® type fastener or the like may be used for this purpose. The tensioner straps provide added structural strength to help keep the two portions attached together, particularly when the tent is moved along the support surface 30 while in the unfolded position.

A preferred embodiment of the shell 16 (FIGS. 1–11) is generally concave with an interior surface 52, an exterior surface 54, and an open bottom 56 defining an outer periphery 58 around the opening. The outer periphery defines a front end 60 and a rear end 62, with a shape symmetrical about a line of symmetry extending between the front and rear ends 60 and 62. A selectively attachable fastener 64, such as Velcro ®, is fixed along the outer periphery 58 of the shell 16. The flexible floormat 42 defines an outer periphery 66 shaped identical to the outer periphery 58 of the shell. A corresponding selectively attachable fastener 68 is fixed along the outer periphery 66 of the flexible floormat 42 so that the outer periphery 58 of the shell 16 may be releasably attached to the outer periphery 66 of the flexible floormat. The releasable attachment allows the shell to be easily detached from the flexible floormat for cleaning the base 12, the floormat 42, or the shell 16.

The shell 16 is made of any type of flexible material that can be folded and reshaped without substantial detrimental effect to the shape of the shell. The shell may be made of more than one piece of material to provide for specifically desired shapes. The preferred embodiment of the shell includes a rearwardly facing aperture 22 through which users can enter into and exit from the interior 20 of the shell 16. The shell is releasably attachable to the flexible floormat 42 along its periphery, as described above, and is placed symmetrically over the fold line 14.

Figure 2:
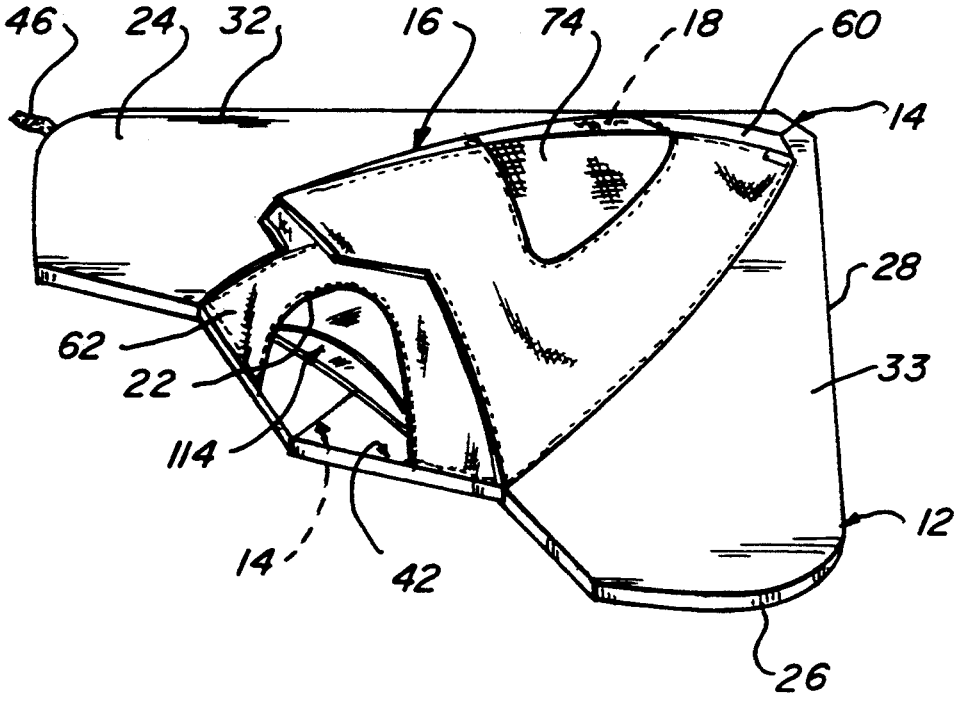
FIG. 2 is an isometric view of the opposite side of the self-erecting tent shown in FIG. 1.
Figure 3:
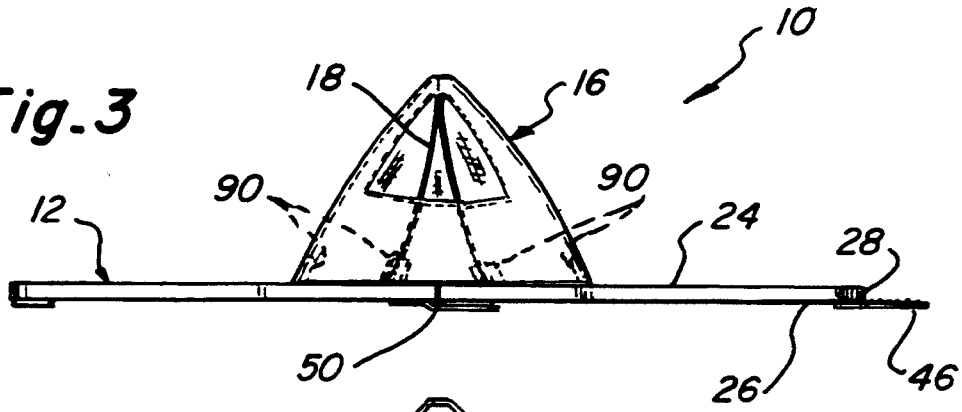
FIG. 3 is an elevational view of the self-erecting tent shown in FIG. 1.
Figure 4:
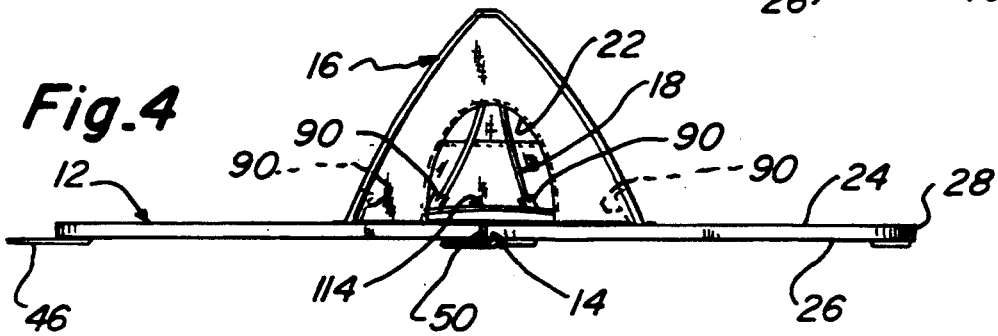
FIG. 4 is an elevational view similar to FIG. 3, showing the opposite side of the tent.

In one preferred embodiment, the shell resembles the fuselage of a spacecraft and when attached to the base completes the structure of a toy spacecraft, as shown in FIGS. 1 and 2. The shell also preferably includes a transparent portion 74 or viewport which acts as a window. The concave shape of the shell is sufficiently large to hold one adult or allow one or more children to play comfortably inside.

Figure 6:
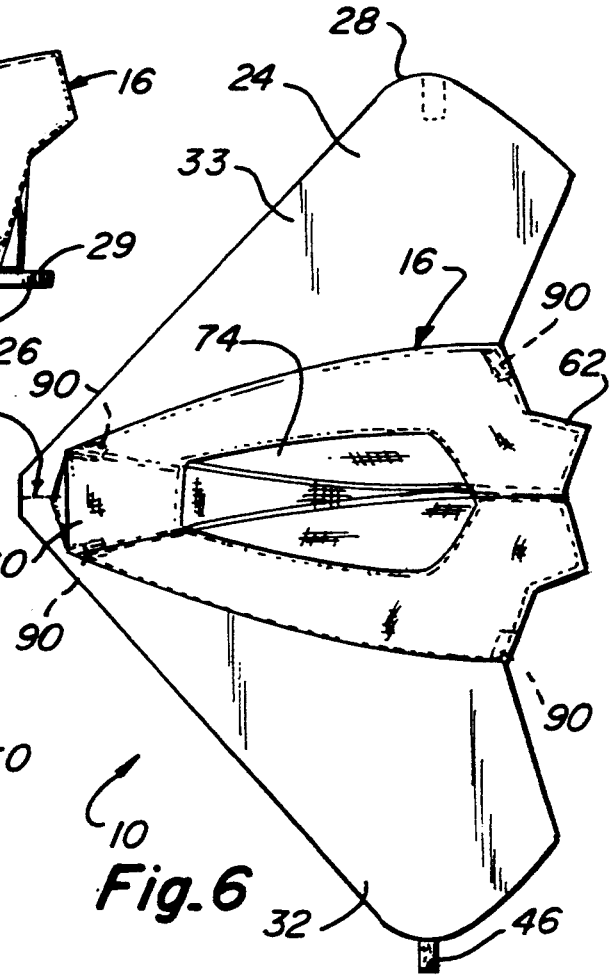
FIG. 6 is a plan view of the tent shown in FIG. 1.
Figure 8:
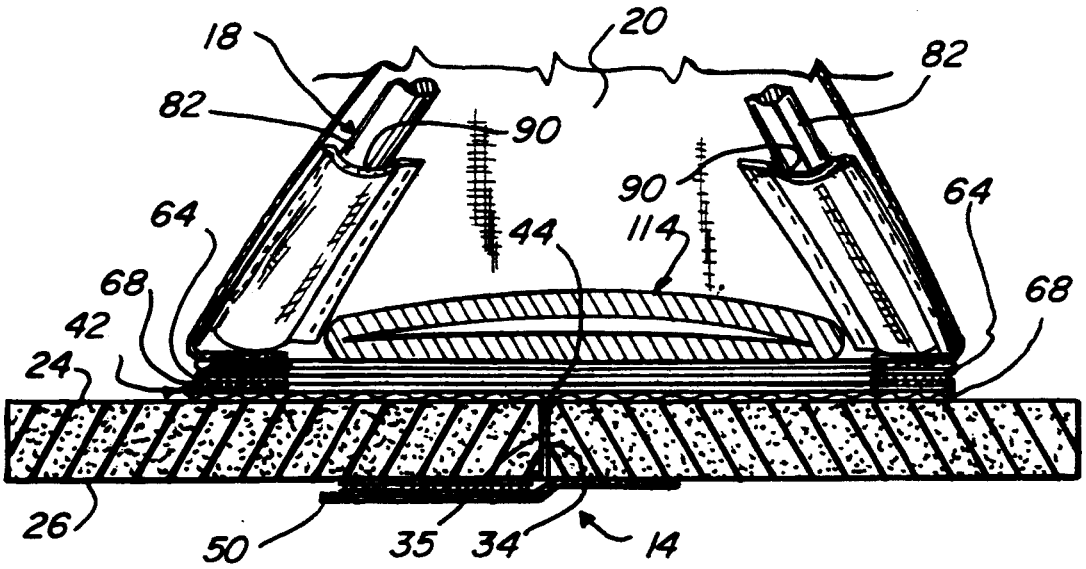
FIG. 8 is a section view taken substantially along the line 8—8 of FIG. 5.

The shell 16 is supported along its interior surface 52 above the top surface of the base 12 by the resilient frame member 18 when the tent is in the open position (FIGS. 6, 8, and 11). The resilient frame member 18 allows the shell and frame member to collapse between the two base halves 32,33 when the base is folded, and also automatically erects the shell and frame member when the base is unfolded. The elongated frame member 18 symmetrically spans the fold line 14 to allow the frame to collapse appropriately between the two base halves 32,33 when the base 12 is closed. The frame member includes a first end 76 and a second end 78, as shown in FIG. 11. The first end is attached to the front end 60 of the shell 16 and the second end 78 is attached to the rear end 62 of the shell.

In a preferred embodiment, the frame member 18 comprises two elongated flexible elements 80,81, each having a first end 82, a second end 84, and a middle portion 86; the two elements being attached together by a frame fastener 88, as shown in FIG. 11. The frame fastener allows the individual frame elements 80,81 to rotate relative to each other to allow the frame 18 to collapse and expand between the portions of the base 12 in the folded and unfolded positions, respectively.

The frame member 18 is preferably secured to the shell 16 by each end 82,84 of each frame element 80,81 fitting into a corresponding pocket 90 integrally formed in the shell 16, the pockets 90 being located adjacent the periphery 58 of the shell at both the front 60 and rear 62 end of the shell, as shown in FIGS. 1, 3, 6, 8, and 11. The first ends 82 of the two frame elements are received in pockets 90 at the front end 60 of the shell, while the second ends 84 of the frame elements are received in pockets 90 at the rear end of the shell. The first 82 and second 84 ends of each frame element are attached to the shell 16 on the same side of the fold line 14. However, the two different first ends 82 of the frame elements are on opposite sides of the fold line, as are the second ends 84 of the frame elements.

The pockets 90 hold the ends of the frame elements 80,81 in the proper position to support the shell 16 when in the unfolded position. The pockets 90 also provide the frame elements the flexibility to collapse onto one another to fold between the base portions 32,33 in the folded position. The ability of the shell 16 to be easily detached from the base 12, as described above, allows the separate frame elements 80,81 to be easily fitted within the pockets 90 prior to attaching the combined shell 16 and frame 18 to the flexible floormat 42.

The bodies of the separate frame elements may be shaped as necessary to match the desired shape of the shell. The frame elements 80,81 illustrated in FIG. 11 are bent as shown to form the rear of the spacecraft fuselage. The position of the frame 18 is maintained on the inside of the shell by the tautness of the shell material over the frame elements 80,81. Proper positioning is necessary to ensure that the frame elements can act to automatically erect the shell when the base is unfolded. If the frame elements move out of place, the shell will not fully erect then the base is unfolded. The middle portions 86 of the frame elements 80,81 may be secured in their proper position by a loop fastener (not shown) attached to the interior surface 52 of the shell.

Figure 14:
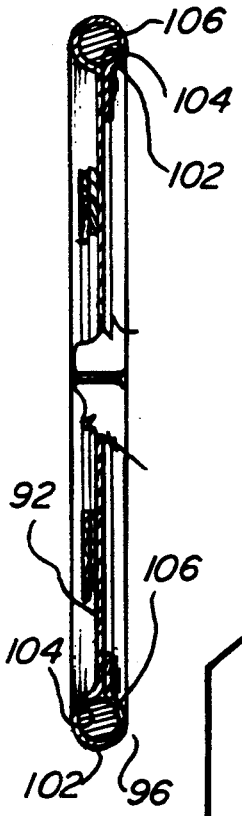
FIG. 14 is a section view taken substantially along the line 14—14 of FIG. 13.
Figure 13:
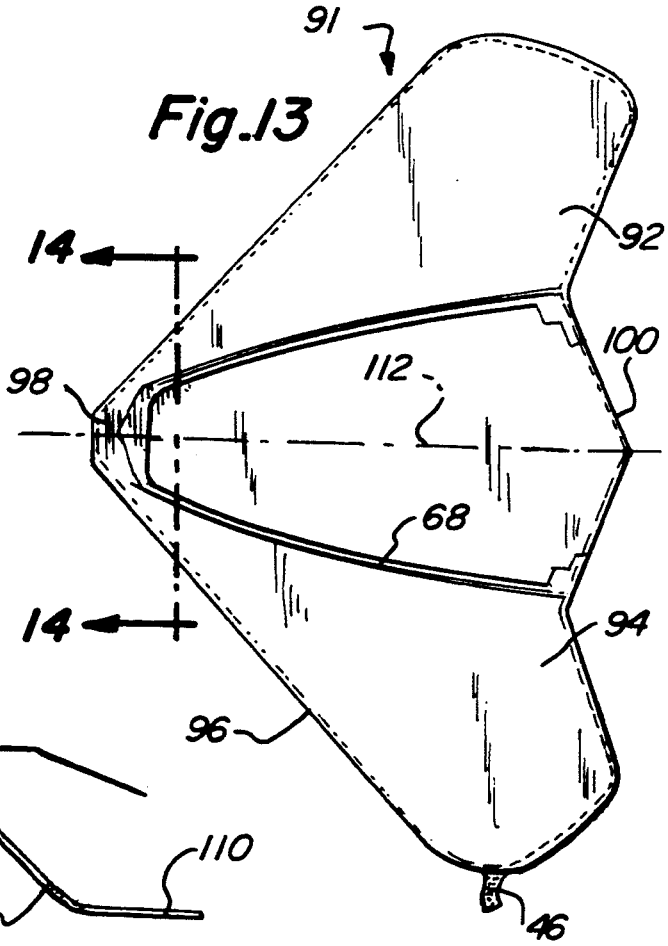
FIG. 13 is a plan view of the alternative preferred embodiment shown in FIG. 12.
Figure 12:
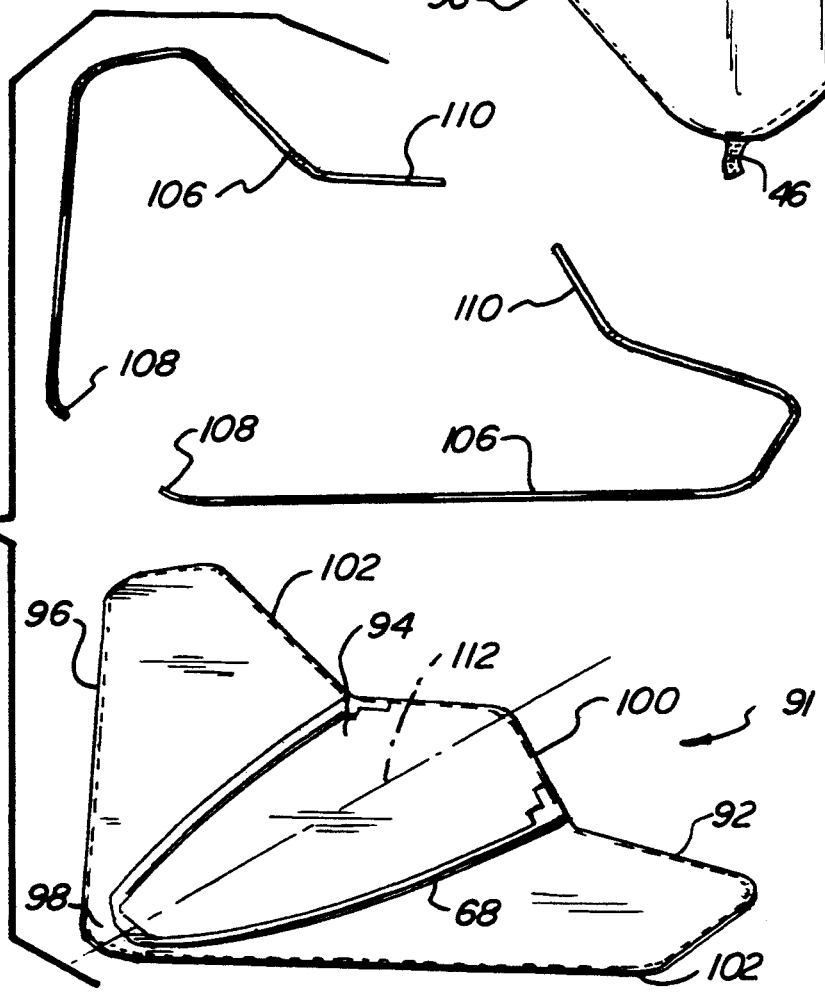
FIG. 12 is an exploded view of an alternative preferred embodiment of the self-erecting tent shown in FIGS. 1–11.

In a second embodiment 91 of the tent, as shown in FIGS. 12–14, the base 92 is not padded, but instead comprises a thin flexible sheet 94 forming a symmetrical one-piece shape having an outer periphery 96, and defining a front end 98 and a rear end 100. The outer periphery of the base is hemmed, forming a channel 102 around the outer periphery. The channel is broken at two locations to form channel openings 104, and two identical base frame members 106 are inserted through the channel openings and received in the channels to provide shape and rigidity to the base 92. The base frame members may be formed of any suitable material, such as plastic or metal. Each base frame member 106 has a front end 108 and a rear end 110, and when in their corresponding channels the front ends 108 of the base frame members are at the front end 98 of the base, and the rear ends 110 of the base frame members are at the rear end 100 of the base. The line between the opposite ends of the base frame members 106 defines the fold line 112, delineating identical first and second halves. The base 92 pivots into the closed position about the fold line 112.

The fastener 68 for releasably attaching the combined shell 16 and frame 18 to the base 92 may be attached directly to the base since there is no floormat 42, as shown in FIGS. 12, 13, and 14. The fastener 68 is attached to the base 92 in the same shape as the periphery 58 of the shell 16.

A sleeping bag 114 is releasably attachable to the top surface 24 of the base 12 inside the shell 16 of each of the preferred embodiments, as shown in FIGS. 2, 4, 8, 10, and 11. The sleeping bag 114 fits entirely within the shell 16. The sleeping bag fastener 116 uses a portion of the same fastener 68 (FIG. 13) that attaches the outer periphery of the shell to the base 12. The outer periphery 58 of the shell does not cover all of the fastener 68 attached to the base, allowing the sleeping bag to attach to the fastener while the shell is attached to the base.

Figure 9:
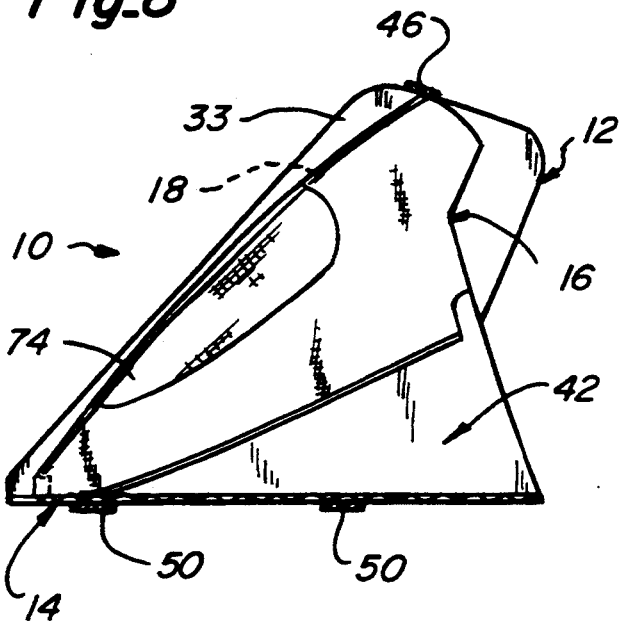
FIG. 9 is a section view taken substantially along the line 9—9 of FIG. 7.

The tent of the present invention provides many improvements over the prior art. In both of the preferred embodiments, the base extends beyond the outer periphery of the shell to provide a seating surface to protect the user from the support surface. The padded base provides more cushioning than the sheet material base, and thus may provide more comfort on hard support surfaces. The convenience by which the tent collapses for storage and automatically erects for use also provides a unique advantage over the prior art. Additionally, the shell and frame member fit fully within the outer periphery of the base when in the closed position, as shown in FIG. 9.

Presently preferred embodiments of the present invention and many of its improvements have been described with a degree of particularity. The previous description is of preferred examples for implementing the invention, and the scope of the invention should not necessarily be limited by this description. The scope of the present invention is defined by the scope of the following claims.

The invention claimed is:

1. A self-erecting and collapsible tent, comprising:

a base having a top surface and a bottom surface, said base having a shape which is symmetrical about a fold line, said fold line delineating identical first and second halves which are selectively moveable between an open position in which the bottom surface of said base is supported on a substantially planar support surface and a closed position in which said two halves are folded over upon one another along said fold line;

a shell of substantially concave shape having an exterior surface, an interior surface, and an open bottom defining an outer periphery around said open bottom, said outer periphery defining a front end and a rear end, and having a shape symmetrical about a line of symmetry extending between said front end and said rear end, said outer periphery of said shell releasably attached to said top surface of said base so that said line of symmetry is coincident with and overlies said fold line of said base and so that said shell may be detached from said top surface to provide access to said base;

a resilient frame member supporting said shell above said top surface of said base to define an interior volume between said base and said interior surface of the shell when said first and second halves of said base are in said open position; and said shell and said resilient frame member fitting between said first and second halves of said base when said two halves are moved to said closed position.

2. A tent as defined in claim 1, wherein:

said resilient frame member includes a first end fixed to the interior surface of said shell adjacent said front end of the shell and a second end fixed to said interior surface of the shell adjacent said rear end of the shell.

3. A tent as defined in claim 1, wherein said resilient frame member comprises a first element and a second element, said first and second elements having each having a first end, a second end, and a middle portion, said first ends of said frame elements being attached to said front end of said shell on opposite sides of said fold line, and said second ends of said frame elements being attached to said rear end of said shell on opposite sides of said fold line, said middle portions of said frame elements being operably attached to one another at one point along their lengths, said frame elements acting to automatically erect and support said shell when said first and second base halves are moved to said open position, and said elements acting to collapse said shell to fit between said first and second base halves when said base halves are moved to said closed position.

4. A tent as defined in claim 3, wherein:

said base defines an outer periphery; and said shell and said resilient frame member fitting completely within said outer periphery of said base between said first and second base halves when said two base halves are moved to said closed position.

5. A tent as defined in claim 3, further comprising:

an aperture at said rear end of said shell to allow a user to enter and exit the interior volume; and a viewport formed within said shell.

6. A tent as defined in claim 3, further comprising:

a sleeping bag releasably attached to the top surface of said base, said sleeping bag fitting within said shell.

7. A tent as defined in claim 3, further comprising:

a fastener strap releasably attached to said bottom surfaces opposite said fold line when said base halves are folded into said closed position to assist in keeping base halves in the closed position.

8. A tent as defined in claim 1, wherein:

said base is padded and semi-rigid to provide for user comfort;

said first half of said base is separate from said second half of said base, each of the two base halves having an outer end, an inner end, a top surface and a bottom surface;

said inner end of said first half abuts said inner end of said second half along said fold line; and further comprising:

a flexible floormat fixedly attached to said top surface of said first and second base halves to connect said two base halves, said flexible floormat folding over upon itself when said two base halves are folded over upon one another along said fold line.

9. A tent as defined in claim 8, wherein:

said flexible floormat defines an outer periphery having the same shape as said outer periphery of said shell; and said outer periphery of said shell is releasably attached to said outer periphery of said flexible floormat.

10. A tent as defined in claim 8, further comprising:

a tensioner strap releasably attached to said bottom surfaces of said base halves across said fold line when said base is in said open position to assist in holding said inner edges of said two base halves together along said fold line.

11. A tent as defined in claim 1, wherein said base comprises a thin flexible sheet having a front end and a rear end corresponding to said front end and said rear end of said shell, respectively, said base further defining an outer periphery with a hem formed along the outer periphery to define a channel therealong, and further comprising:

a first flexible base frame member having a front end and a rear end and being received within said channel around said first half of said base;

a second flexible base frame member having a front end and a rear end and being received within said channel around said second half of said base;

said front ends of both of said base frame members abutting at said front end of said base at said fold line; and said rear ends of both of said base frame members abutting at said rear end of said base at said fold line to allow said first and second halves of said base to fold along said fold line when moved to said closed position.

12. A self-erecting and collapsible tent, comprising:

a base having a top surface and a bottom surface, said base having a shape defining an outer periphery which is symmetrical about a fold line, said fold line delineating identical first and second halves which are selectively moveable between an open position in which the bottom surface of said base is supported on a substantially planar support surface and a closed position in which said two halves are folded over upon one another along said fold line;

a shell of substantially concave shape having an exterior surface, an interior surface, and an open bottom defining an outer periphery around said open bottom, said outer periphery defining a front end and a rear end, and having a shape symmetrical about a line of symmetry extending between said front end and said rear end, said outer periphery of said shell attached to said top surface of said base so that said line of symmetry is coincident with and overlies said fold line of said base and so that said outer periphery of said shell does not extend beyond said outer periphery of the base;

a resilient frame member supporting the shell above said top surface of said base to define an interior volume between the base and the interior surface of the shell when the first and second halves of the base are in the open position; and the top surface of the base between the outer periphery of the base and the outer periphery of the shell provides seating areas on top of the support surface which are not contained within the interior volume.

13. A tent as defined in claim 12, wherein:

said shell and said resilient frame member fit completely between the first and second halves of the base when the two halves are moved to the closed position.

14. A tent as defined in claim 12, wherein:

said periphery of said shell is selectively detachable from the top surface of the base.

15. A tent as defined in claim 12, wherein:

said resilient frame member includes a first end fixed to the interior surface of said shell adjacent said front end of the shell and a second end fixed to said interior surface of the shell adjacent said rear end of the shell.

16. A tent as defined in claim 12, wherein said resilient frame member comprises a first element and a second element, said first and second elements each having a first end, a second end, and a middle portion, said first ends of said frame elements being attached to said front end of said shell on opposite sides of said fold line, and said second ends of said frame elements being attached to said rear end of said shell on opposite sides of said fold line, said middle portions of said frame elements being operably attached to one another at one point along their lengths, said frame elements acting to automatically erect and support said shell when said first and second base halves are moved to said open position, and said elements acting to collapse said shell to fit between said first and second base halves when said base halves are moved to said closed position.

17. A tent as defined in claim 12, wherein:

said base is padded and semi-rigid to provide for user comfort;

said first half of said base is separate from said second half of said base, each of the two base halves having an outer end and an inner end;

said inner end of said first half abuts said inner end of said second half along said fold line; and further comprising:

a flexible floormat fixedly attached to said top surface of said first and second base halves to connect said two base halves, said flexible floormat folding over upon itself when said two base halves are folded over upon one another along said fold line.

18. A tent as defined in claim 17, wherein:

said flexible floormat defines an outer periphery having the same shape as said outer periphery of said shell; and said outer periphery of said shell is releasably attached to said outer periphery of said flexible floormat.

19. A tent as defined in claim 12, wherein said base comprises a flexible sheet having a front end and a rear end corresponding to said front end and said rear end of said shell, respectively, said base further defining an outer periphery with a hem formed along the outer periphery to define a channel therealong, and further comprising:

a first flexible base frame member having a front end and a rear end and being received within said channel around said first half of said base;

a second flexible base frame member having a front end and a rear end and being received within said channel around said second half of said base;

said front ends of both of said base frame members abutting at said front end of said base at said 15 fold line; and said rear ends of both of said base frame members abutting at said rear end of said base at said fold line to allow said first and second halves of said base to fold along said fold line when moved to said closed position.

* * * * *